United States Patent [19]

Watanabe et al.

[11] Patent Number: 4,821,971

[45] Date of Patent: Apr. 18, 1989

[54] DEVICE FOR PEELING AND CUTTING OFF SURFACE PORTIONS OF PAPER ROLLS

[75] Inventors: Takemi Watanabe, Osaka; Noriyuki Shiba, Tokyo, both of Japan

[73] Assignees: Kabushiki Kaisha Kaneda Kikai Seisakusho, Osaka; Kabushiki Kaisha Tokyo Kikai Seisakusho, Tokyo, both of Japan

[21] Appl. No.: 169,264

[22] Filed: Mar. 17, 1988

[51] Int. Cl.[4] ..... B65H 16/00; B26D 1/10

[52] U.S. Cl. ..... 242/55; 242/58.3; 242/78.8; 83/614; 83/649

[58] Field of Search ..... 242/56 R, 58.1–58.5, 242/78.8; 83/649, 614, 455, 563; 156/502, 504, 505, 506, 510

[56] References Cited

U.S. PATENT DOCUMENTS

| | | | |
|---|---|---|---|
| 2,674,309 | 4/1954 | Bigelow | 156/584 |
| 4,278,489 | 7/1981 | Horsley | 242/58.2 X |
| 4,399,729 | 8/1983 | Malinowski et al. | 83/649 X |
| 4,543,152 | 9/1985 | Nozaka | 242/58.4 X |
| 4,637,567 | 1/1987 | Tanaka et al. | 242/56 R |
| 4,668,328 | 5/1987 | Kyytsonen | 242/58.4 X |
| 4,683,022 | 7/1987 | Watanabe et al. | 242/58.3 X |
| 4,685,392 | 8/1987 | Watanabe | 101/226 |
| 4,721,263 | 1/1988 | Miyazaki | 242/78.8 X |

FOREIGN PATENT DOCUMENTS

| | | | |
|---|---|---|---|
| 60-252561 | 12/1985 | Japan . | |
| 727257 | 8/1980 | U.S.S.R. | 83/649 |

*Primary Examiner*—John M. Jillions

*Attorney, Agent, or Firm*—Griffin, Branigan & Butler

[57] ABSTRACT

A device for peeling and cutting off a surface portion (4c) of a paper roll (4) comprises a rotary support (1) that rotates the paper roll (4), a cutter guide (2) that reciprocally moves between positions for contacting and not contacting the paper roll surface portion, and a cutting device (3) that reciprocally moves parallel to a paper roll axis for cutting off the surface portion. In the contacting position, the cutter guide enters under the surface portion via a leading end (4a) of the paper roll when the paper roll is rotated and thereby forms a clearance under the surface portion. The cutter is inserted in the clearance and moves parallel to the paper roll axis to cut off only the surface portion of the paper roll along its entire width.

10 Claims, 11 Drawing Sheets

DEVICE FOR PEELING AND CUTTING OFF SURFACE PORTIONS OF PAPER ROLLS

FIELD OF THE INVENTION

The present invention relates to equipment used in an initial process for preparing paper rolls for web pasting which is required in a continuous supply of paper rolls to a rotary press for newspaper, magazine, or other types of printing. More specifically, the invention relates to a device for peeling and cutting off a surface portion, or outer layers, of a paper roll that is fastened by adhesive tape or the like.

PRIOR ART

When printing newspapers, magazines or the like, paper rolls are continuously supplied to a rotary press. This continuous supplying of paper is performed, as shown in FIG. 11, by using first, second, and third reels $33_1$, $33_2$, $33_3$. That is, when a small amount of paper remains on a first paper roll $4_1$, a rotary drive 35 rotates a second paper roll $4_2$ attached to the second reel $33_2$ in the direction in which the first paper roll $4_1$ is being fed at a speed equal to the rotating speed of the first paper roll $4_1$, with the first paper roll $4_1$ attached to the first reel $33_1$ being supplied to a rotary press 34. A pusher 36 subsequently compresses circumferentially that portion of the first paper roll $4_1$, placed in a paper feeding passageway onto the second paper roll $4_2$ and attaches the trailing end of the first paper roll $4_1$, to the leading end of the second paper roll $4_2$. This attachment is carried out via adhesive layers for web pasting formed on the surface of a second paper roll $4_2$ leading end. After web pasting of the first paper roll $4_1$ to the second paper roll $4_2$, as described above, has taken place the reel 33 rotates 120 degrees in the direction indicated by an arrow to feed the second paper roll $4_2$ onto the rotary press 34. When the second paper roll $4_2$ is depleted, a third paper roll $4_3$ is similarly attached to the second paper roll $4_2$. At the same time, a new paper roll is prepared on the first reel $33_1$.

Thus, to perform the above-mentioned automatic web pasting, the leading end of paper roll $4_2$ must be prepared beforehand. The procedures for web pasting preparation are described with reference to FIGS. 12A and 12D. After several surface layers of paper roll 4, whose leading end has been adhesively held to the rest of the roll by a tape 5, are peeled off, the leading end of the paper roll 4 is cut at its lateral edges into a V-shape and the tip of this V-shaped leading end is then fastened to the paper roll 4 body by a tab (end-fastening strip) 37. Concurrently, a plurality of double-sided adhesive tapes form adhesive layers 38 on the outer surface of the V-shaped leading end of the paper roll 4.

Regarding the above-mentioned preparation procedures for web pasting, however, outer layer(s), or a surface portion, is generally peeled off the roll 4 and cut off manually. More specifically, an operator inserts a bamboo spatula into several layers under the surface and moves the spatula in the direction of the paper roll 4 axis to cut off the outer layer(s), or surface portion, that may have been damaged during transportation.

The above manual preparation for web pasting presents various problems, such as operation inefficiency, potential damage to usable inner paper layers, which is likely to occur upon peeling off the outer surface portion of the paper roll 4, and a resulting large volume of paper loss.

Accordingly, a device that automatically performs the initial process of web-pasting preparation has been recently developed to solve these problems. This device, described in Japanese patent application No. 110176/84, comprises, as shown in FIG. 13: a rotary support 39, which rotatably secures the paper roll 4 on its axis; a suction device 41, including a suction component 40 that externally picks up the leading end portion of the paper roll 4; and a cutting device 43 provided with a cutting edge 42 that cuts off the entire width of the picked-up leading end portion of the paper roll 4. The suction component 40 picks up and substantially releases the leading end portion of the paper roll 4 secured by the rotary support 39, as shown in FIG. 13A. Upon the leading end portion being pierced by the cutting edge 42, as shown in the FIG. 13B, the surface layer of paper roll 4 is cut off. In FIG. 13, numeral 44 denotes a hydropneumatic cylinder which reciprocally moves the suction component 40. Numeral 45 represents a hydropneumatic cylinder which reciprocally moves the cutter 42, and numeral 46 denotes a sensor which identifies the leading end of the paper roll 4.

However, the surface layer of the paper roll 4 may not be properly or sufficiently cut off even though the above-mentioned peeling and cutting device is used, since the compacted conditions differ for each paper roll.

More specifically, when the paper roll 4 is compactly rolled up, the suction device 41 cannot properly pick up the surface paper.

On the contrary, when the paper roll 4 is loosely rolled up, the suction device 41 takes up a plurality of surface layers; thus, usable, clean, paper under the damaged portion is consequently cut off, which may result in a larger volume of paper loss. Moreover, the cutter 42 may not adequately pierce the paper roll 4.

SUMMARY

A first object of the present invention is to provide a device which automatically peels and cuts off leading end portions of paper rolls.

A second object is to provide a device which properly and sufficiently peels and cuts off surface portions of paper rolls without wasting paper.

A third object is to provide a device that smoothly transports paper rolls to a following process, such as a tab-attaching process, after peeling and cutting off the surface portion of paper rolls, and that efficiently performs preparation for web pasting.

The above objects are achieved by a device embodying the present invention, comprising: a rotary support that rotatably secures a paper roll, whose leading end is fastened to the rest of the roll except for lateral portion thereof; a cutter guide device that can be placed at a position adjacent the lateral portion of the leading end portion of the paper roll, whereby the cutter guide is automatically inserted under an outer most layer via a leading end of the paper roll to form a clearance under the surface portion at the lateral portion of the paper roll by rotary movement of the paper roll in a direction in which the paper roll is unrolled; and a cutting device including a cutter that reciprocally moves along the paper roll axis, whereby the cutter is inserted into the above-mentioned clearance formed in the paper roll to cut off the entire width of the surface portion of the paper roll.

More specifically, the cutter guide has an entrance that juxtaposes the lateral portion of the surface portion of the paper roll and a protruding clearance-forming section connected smoothly to the entrance. When a paper roll is rotated in the unrolling direction, the entrance slides on the lateral surface portion of the paper roll and enters under the surface portion from the lateral portion of the leading end, which is not fastened. After the entrance is properly inserted, the protruding clearance-forming section enters under the surface portion. As a result, a clearance is formed under the surface portion. The cutter guide is inserted under the surface portion with more accuracy when compressed gas, such as compressed air, is sprayed from a nozzle in the direction of the leading end of the paper roll. Rotary movement of the paper roll stops after the cutter guide is inserted a predetermined amount circumferentially from the leading end of the paper roll.

The cutter comprises a guide that contacts a paper roll surface under the surface portion, and a cutting edge attached to the guide. The guide is inserted under the surface portion via the clearance formed by the cutter guide device. When the cutter moves along the paper roll parallel to its axis with the guide being inserted under the surface portion, the surface portion is gradually cut by the cutting edge and, finally, the entire width of the paper roll is completely cut off. According to the above arrangement, the cutting edge properly cuts off the surface portion with no cutting errors or damage to the paper roll other than the surface portion; thus, only the surface portion is completely cut off. In particular, when the cutter is allowed to pivot and the cutter is pressed by a spring to contact the layers under the paper roll surface portion, the guide can properly perform its operation regardless of an irregular surface formed on the layers under the paper roll surface portion, thus enhancing an excellent cutting operation of the cutting edge for cutting off the surface portion.

Other objects, features, aspect, and advantages of the present invention will become apparent upon consideration of the following detailed description of the invention when taken in conjunction with the accompanying drawings.

DESCRIPTION OF A PREFERRED EMBODIMENT

Figure 1:
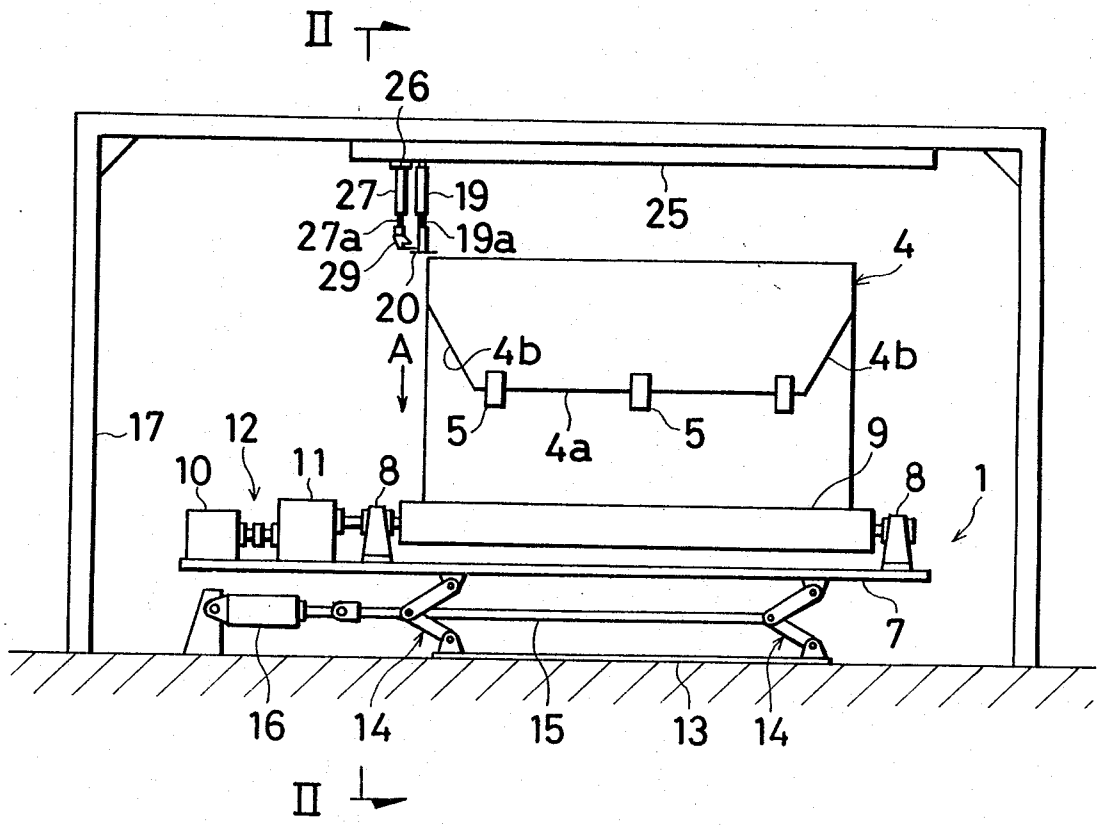
FIG. 1 schematically shows a side view of a device embodying the present invention.
Figure 2:
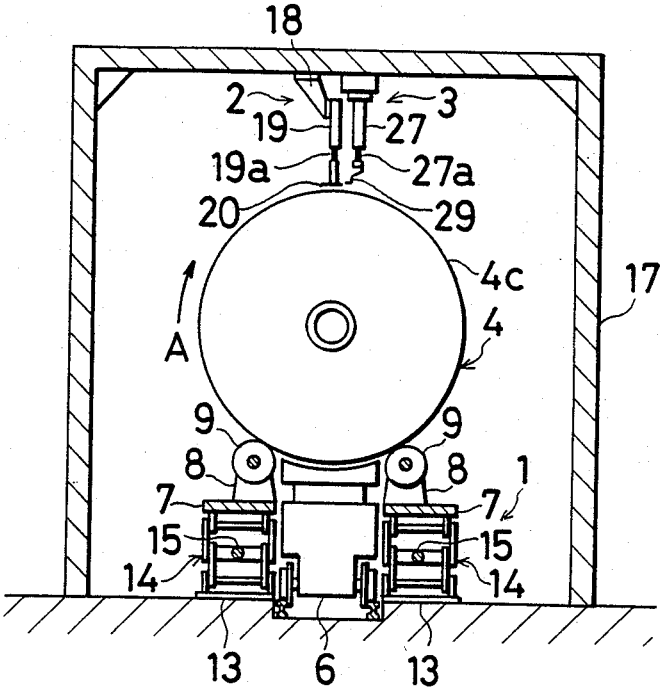
FIG. 2 is a sectional view taken along line II—II of FIG. 1.

A device embodying the present invention is installed adjacent to a passageway of a paper roll to a rotary press, and comprises, as shown in FIG. 1 and FIG. 2: a rotary support 1, which receives a paper roll 4 transported by a truck 6, conveyor, or the like, and which supports and rotates the paper roll 4 on its axis; a cutter guide device 2 disposed above the rotary support 1; and a cutting device 3. A leading end 4*a* of the paper roll 4 has its lateral edges cut into a V-shape, and a central portion of this leading end 4*a* is adhesively attached by a tape 5 to the rest of the roll at several positions.

As mentioned above, the rotary support 1 receives the paper roll 4 transported from the truck 6, conveyor, or the like, and roatably maintains the paper roll 4.

More specifically, the rotary support 1 includes: a pair of climbing plates (right and left) 7 horizontally disposed parallel to the axis of the paper roll 4 mounted thereon; two rollers 9 each being rotatably and horizontally supported by a respective climbing plate via bearings 8; a drive device 12 attached to the climbing plates 7, comprising a motor 10 and a reduction gear assembly 11 that rotates each roller 9; a vertically-extensible linking device 14 disposed between a base frame 13, which is installed on a floor, and each climbing plate 7; a rod 15 disposed between axial supports of each linking device 14; and a hydropneumatic cylinder 16 disposed between the rod 15 and a floor-mounted brace which extends the linking devices 14 by reciprocally moving the rod 15. The space between the right and left climbing plates is so arranged that the truck 6 with the paper roll 4 can pass therethrough.

In operation of the rotary support 1, the climbing plates 7 ascend so that the rollers 9 contact the paper roll 4 when it is transported to the rollers 9, and the paper roll 4 is there securely placed on the rollers 9. When the motor 10 begins operation with the paper roll 4 thereon, the rollers concurrently rotate the paper roll 4 about its axis.

The constitution of the rotary support is not limited to that described in the above-mentioned embodiment, and any arrangement or type of device may be employed at any desired, appropriate location, so long as the device can receive the transported paper roll 4 and rotatably secure the paper roll 4 on its axis. For example, devices disclosed in Japanese Provisional Publication No. 12561/86, Japanese Utility Model Application No. 108241/86, and Japanese patent application No. 32038/87 may be used as the rotary support.

The cutter guide device 2 is attached to a frame 17, which is installed on the floor adjacent to the rotary support 1 to extend upwardly. A cutter guide element 20 is capable of entering under a surface portion 4c (FIGS. 6A, 7A, 8A and 9A) of the paper roll 4 maintained by the rotary support 1 and forming a clearance 4e (FIG. 9A) under the surface portion 4c.

More specifically, the guide device 2 comprises a hydropneumatic cylinder 19 attached to and extending downwardly from the frame 17 via bracket 18 located above, but beyond the end of, the paper roll 4, and the cutter guide element 20 fixed to a rod 19a of said hydropneumatic cylinder 19 via a bracket 21 (FIG. 3) and a hinge 22.

Figure 3:
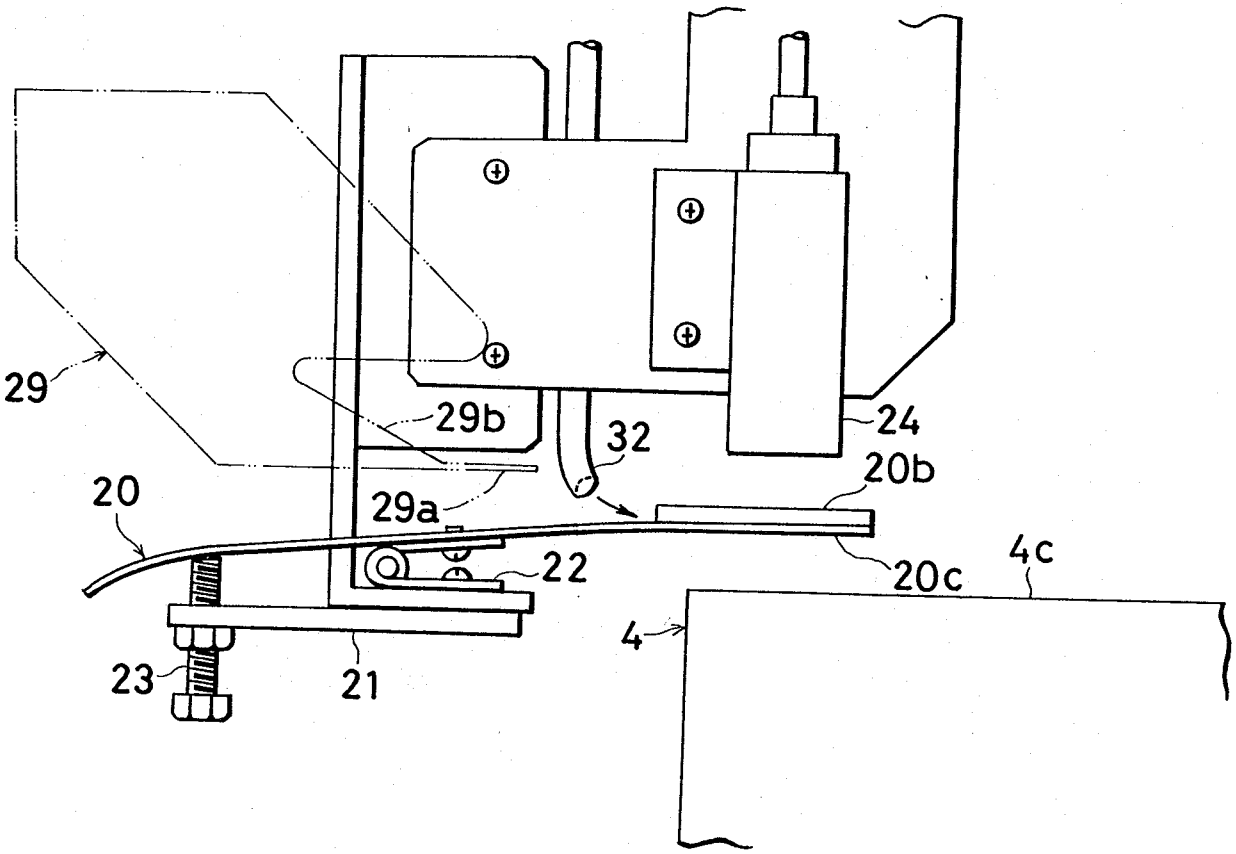
FIG. 3 is a detailed, magnified view of an essential part of the apparatus shown in FIG. 1.
Figure 5:
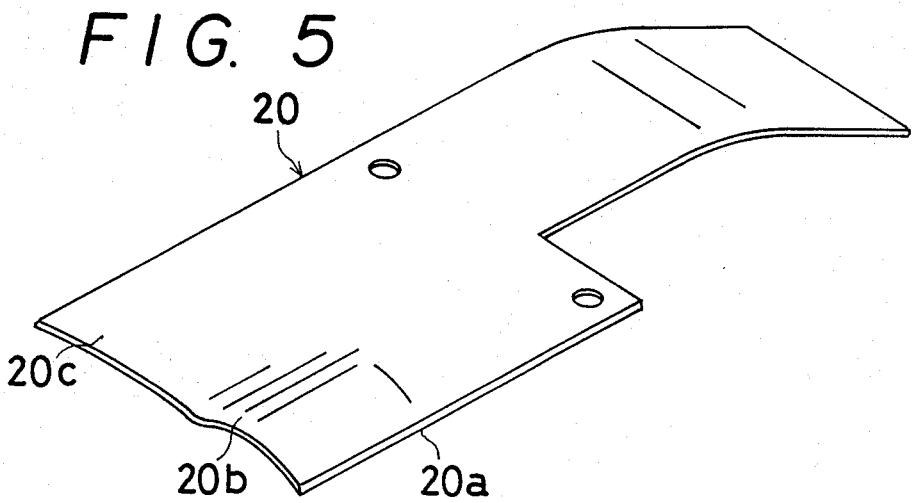
FIG. 5 is a perspective side view of a cutter guide used with the apparatus of FIG. 1.

The cutter guide element 20 comprises, as shown in FIG. 3 and FIG. 5, an entrance 20a that juxtaposes a lateral portion 4b of the surface portion 4c of the paper roll 4, a clearance-forming section 20b having a protruded surface, which smoothly continues from the entrance 20a, and a cutter-leading section 20c that is joined to the clearance-forming section 20b. The entrance 20a is designed in a thin, blade-like shape so that it can easily slide below the lateral portion 4b of the paper roll leading end 4a. The cutter-leading section 20c is slightly bent so as to fit to the surface of the paper roll 4. The appropriate protruding height of the clearance-forming section 20b measured from the surface of the cutter-leading section 20c is 1.5 to 2 mm. The surface portion 4c represents the area of a paper roll from the leading end 4a to the attachment position of the tape 5.

By using the cutter guide device 2, a clearance 4e is formed under the surface portion 4c, as described below.

Figure 6A:
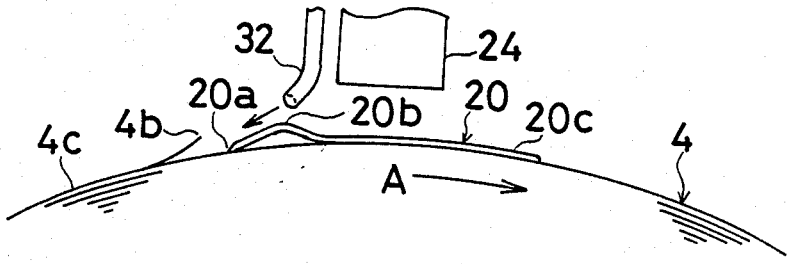
FIG. 6A is a front view of the cutter guide contacting the surface of a paper roll.
Figure 6B:
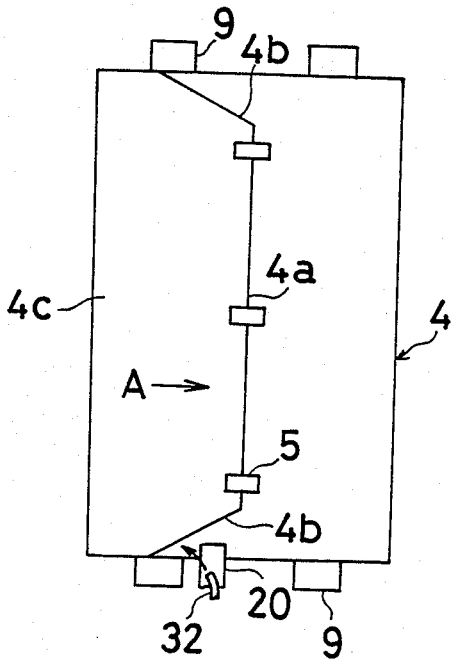
FIG. 6B is a plan view of the cutter guide contacting the surface of a paper roll.

When the guide 20 descends by extensible operation of the cylinder 19, the entrance 20a and cutter-leading section 20c juxtaposes the lateral portion 4b of the paper roll 4 surface portion 4c (FIG. 6A and FIG. 6B). This condition of juxtaposition may be adjusted using an adjustment bolt 23 fixed to the bracket 21.

Figure 7A:
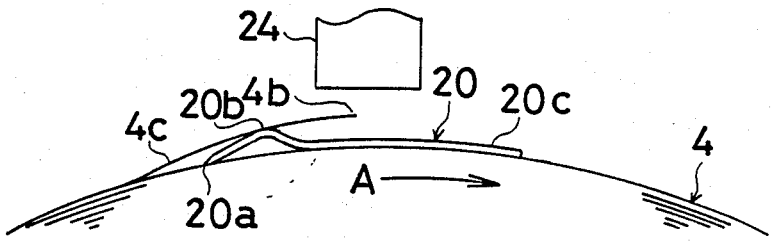
FIG. 7A is a front view of the cutter guide starting to slide under the surface portion of a paper roll.
Figure 7B:
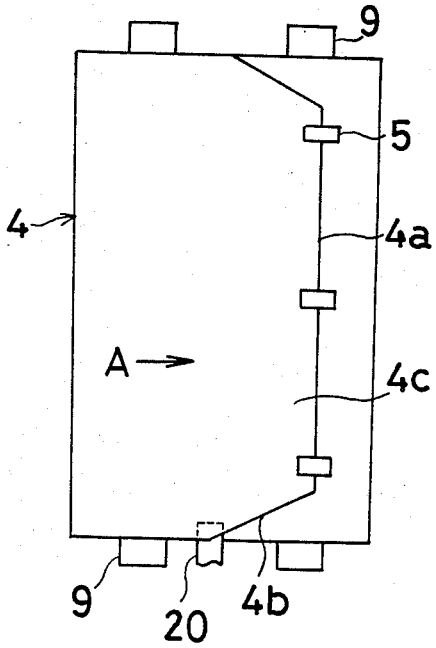
FIG. 7B is a plan view of the cutter guide starting to slide under the surface portion of a paper roll.
Figure 8A:
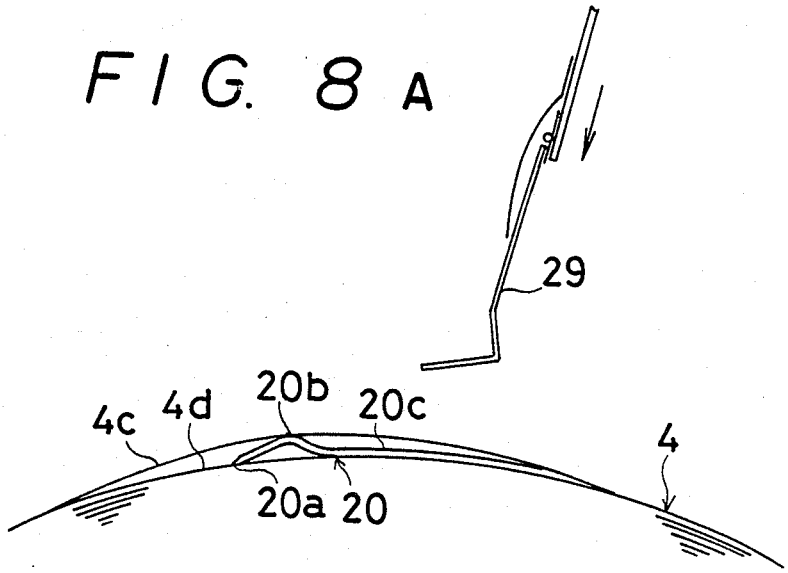
FIG. 8A is a front view of a formed clearance under the surface portion of a paper roll caused by means of the cutter guide.
Figure 8B:
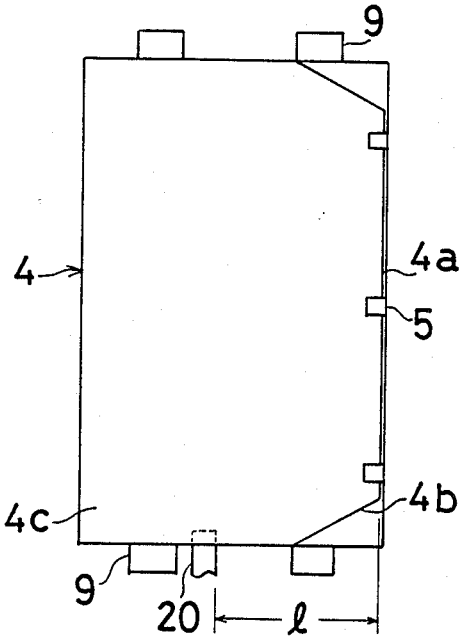
FIG. 8B is a plan view of the cutter guide being slid under the surface portion of a paper roll to a substantial extent.

When the rotary support 1 rotates the paper roll 4 in direction A, the entrance 20a slides on the surface portion 4c of the paper roll 4 and enters under the surface portion 4c via the lateral or angled cut, portion 4b of the leading end 4a, which is not fastened (FIG. 7A and FIG. 7B). After the entrance 20a is properly inserted, the clearance-forming section 20b and cutter-leading section 20c subsequently enter under the surface portion 4c. Consequently, the clearance 4e is formed between the surface portion 4c and cutter-leading section 20c due to the protrusion 20b (FIG. 8A and FIG. 8B).

An entry sensor 24 (FIGS. 3 and 7A), comprising a photo tube, is disposed directly above the cutter-leading section 20c in order to detect that the cutter guide 20 is inserted under the surface portion 4c. To adequately perform the above detection, the cutter guide 20 is painted black. When the sensor 24 detects that the cutter guide 20 has entered under the surface portion 4c, the motor 10 responds to a transmitted signal by stopping operation after a specified time period. That is, the rotary movement of the paper roll 4 automatically stops when the guide 20 is circumferentially inserted for a predetermined length (FIG. 8B). The inserted length should be set at approximately 300 mm.

The bracket 21, as shown in FIG. 3, supports a nozzle 32 that sprays compressed gas, such as compressed air, to the cut portion 4b of the paper roll 4. Spraying compressed gas from the nozzle 32 during insertion of the cutter guide element 20 lifts the cut portion 4b, as shown in FIG. 6A; thereby aiding the guide 20 to be adequately and properly inserted under the surface portion 4c.

The structure of the guide device 2 is not limited to that described in the above embodiment, and any constitution and type of device may be employed at any desired, appropriate location, so long as the device can slide under the surface portion 4c of the paper roll 4 and thereby separate only one layer from the paper roll 4.

The cutting device 3 is provided to cut off the separated portion of the paper roll 4 along the entire width.

Describing the cutting device 3 in more detail, the cutting device 3 comprises: a guide rail 25 (FIG. 1) disposed above the paper roll 4 and attached to the frame 17 parallel to the paper roll axis; a movable body 26 movably attached to the guide rail 25; a drive (not illustrated) comprising a chain drive or a hydropneumatic cylinder, which reciprocally moves the movable body 26 along the guide rail 25; a hydropneumatic cylinder 27 downwardly disposed on the movable body 26; and a cutter 29 affixed to a rod 27a of hydropneumatic cylinder 27 via a bracket 28.

Figure 4:
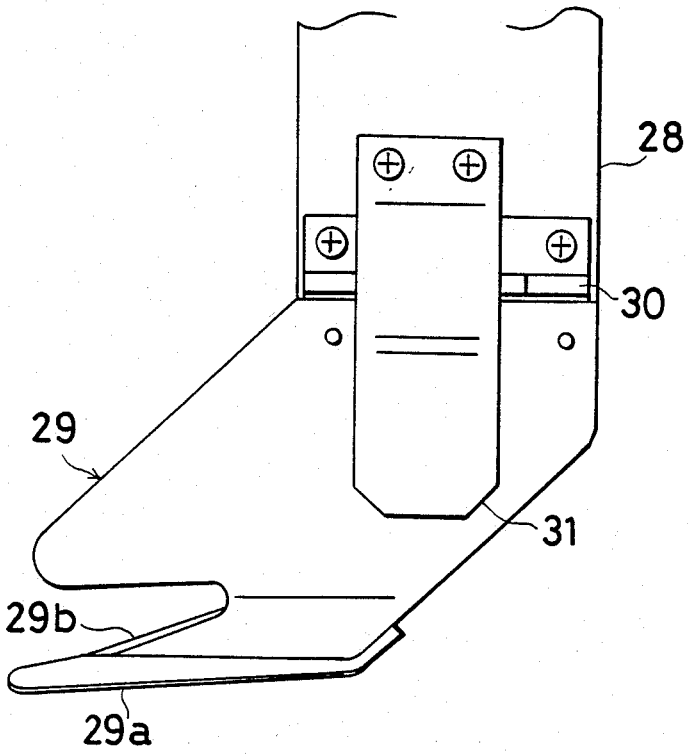
FIG. 4 is a front, enlarged, view of a cutter used with the apparatus of FIG. 1.
Figure 4A:
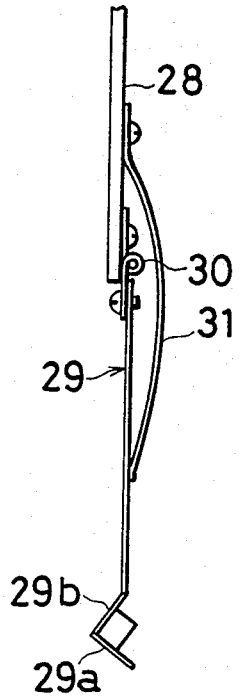
FIG. 4A is a side view of the cutter of FIG. 4.

The cutter 29, as shown in FIG. 4 and FIG. 4a, comprises a guide 29a, which contacts the paper roll surface portion 4d under the surface portion 4c, and cutting edge 29b, which is connected to the guide 29a. Furthermore, the cutter 29 is pivotally attached to the bracket 28 via a hinge 30, and biased by a plate-type spring 31.

In operation of the cutting device 3, the entire width of the surface portion 4c of the paper roll 4 is cut off as described below.

Figure 9A:
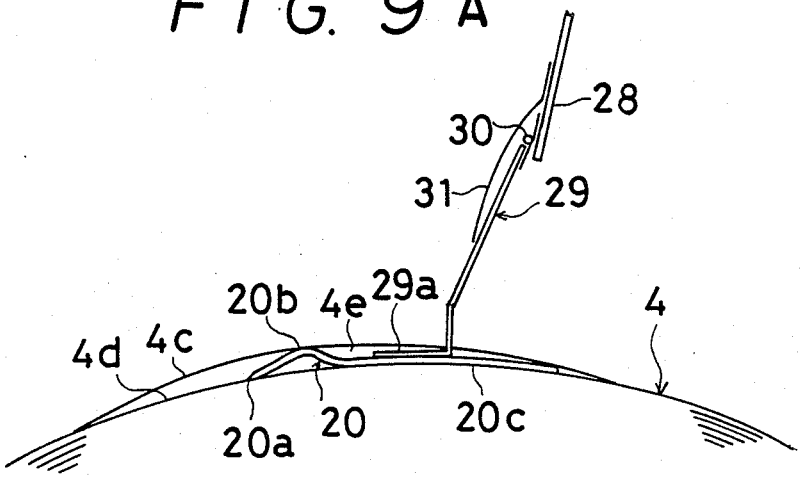
FIG. 9A is a front view showing the surface portion of a paper roll beginning to be cut by the cutter of FIG. 4.
Figure 9B:
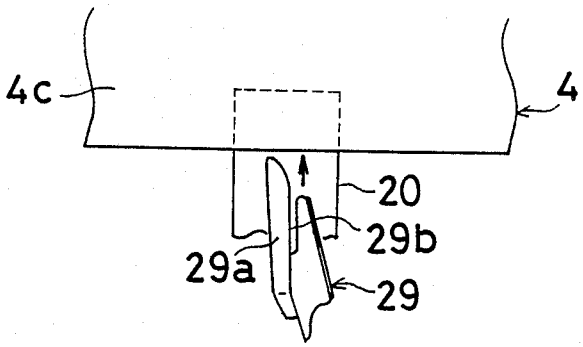
FIG. 9B is a plan view showing the surface portion of a paper roll beginning to be cut by the cutter of FIG. 4.

When the cutter 29 descends by extending the cylinder 27 with the cutter guide element 20 to be inserted under the surface portion 4c, rotary movement of the paper roll 4 is stopped, and the guide 29a is positioned on the cutter-leading section 20c of the guide element 20, which is exposed laterally externally, from the paper roll 4 (FIG. 9A and FIG. 9B). To be more precise, the guide 29a is disposed at a position opposite to the clearance 4e. Concurrently, the cutter 29 is slightly pivoted against the resisting spring 31, to properly contact the guide 29a with the cutter-leading section 20c.

Figure 10A:
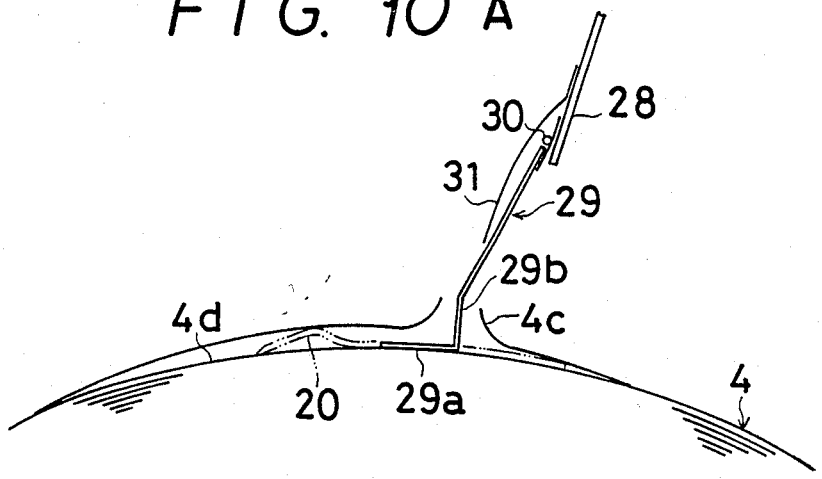
FIG. 10A shows a front view of the surface portion of a paper roll being cut by the cutter of FIG. 4.
Figure 10B:
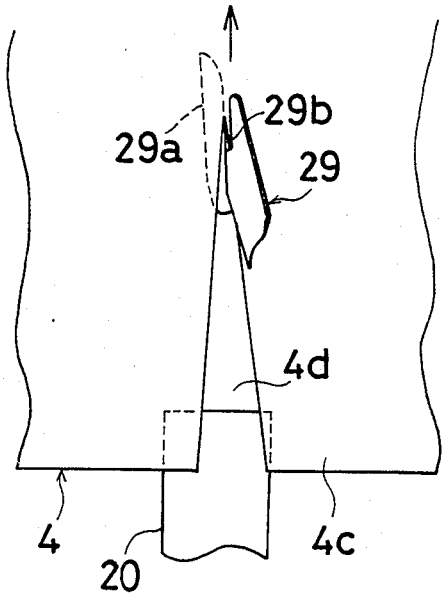
FIG. 10B shows a plan view of the surface portion of a paper roll being cut by the cutter of FIG. 4.
Figure 11:
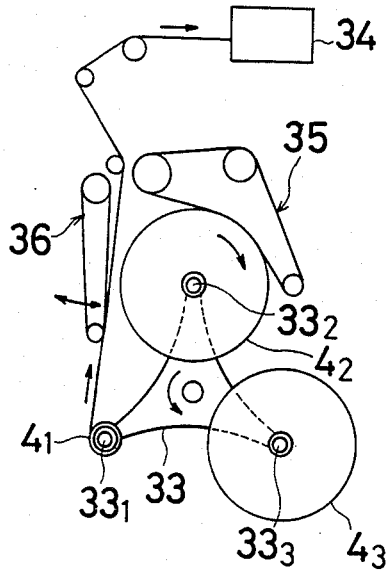
FIG. 11 (PRIOR ART)
FIG. 11 schematically shows a side view of a prior-art paper supplying system for supplying paper to a rotary press.

Moving the movable body 26 along the guide rail 25 according to the above arrangement also moves the cutter 29 parallel to the paper roll 4 axis, and the guide 29a slides on the cutter-leading section 20c and then enters under the surface portion 4c via the clearance 4e. At the same time, compressed gas may be sprayed from the above-mentioned nozzle 32 into the clearance 4e. This additional step ensures separation, for more precise cutting, between the surface portion 4c and the paper roll portion 4d under it. Subsequently, with further movement of the cutter 29, the surface portion 4c is cut off by the cutting edge 29b (FIG. 10A and FIG. 10B). When the guide 29a is advanced beyond the cutter-leading section 20c, the cutter is consequently swung by the pressing force of the spring 31, thereby leading the guide 29a, as shown in FIG. 10A, to properly contact the paper roll portion 4d surface under said surface portion 4c. Even though the contact surface is irregular, the cutter 29 is swung to fit the guide 29*a* to the irregular surface due to the pressing force of the spring 31. According to the above arrangement, the guide 29*a* desirably contacts the paper roll portion 4*d* surface under the surface portion 4*c*. Accordingly, thanks to this arrangement and the fact that the guide 29*a* is inserted under the surface portion 4*c* prior to the cutting operation of the cutting edge 20*b*, disadvantages, such as misalignment of the cutting edge 29*a* from the surface portion 4*c* and damage to the above-mentioned paper roll portion 4*d*, are completely eliminated, and the surface portion 4*c* is properly and sufficiently cut off.

After the entire width of the surface portion 4*c* is cut off, the cutter guide 20 and cutter 29 automatically return to their initial positions.

Figure 12A:
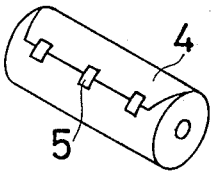
FIG. 12 A (PRIOR ART)
FIGS. 12A through 12D are perspective views showing general preparation steps for web pasting in order of process.
Figure 12C:
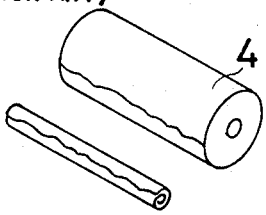
FIG. 12 C (PRIOR ART)
Figure 12B:
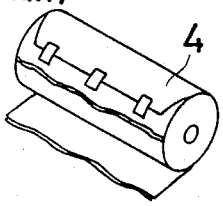
FIG. 12 B (PRIOR ART)
Figure 12D:
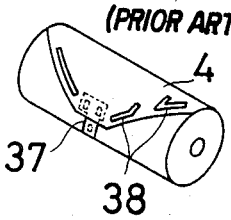
FIG. 12 D (PRIOR ART)
Figure 13:
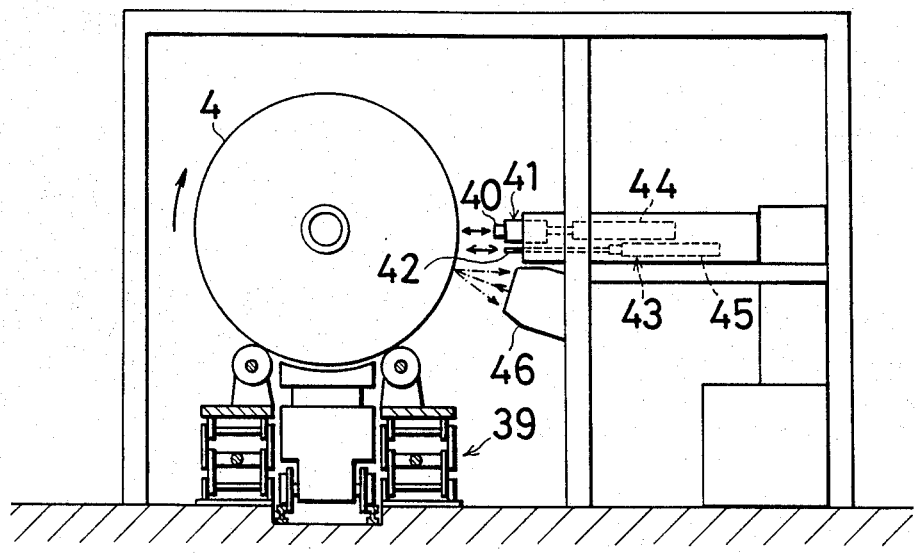
FIG. 13 (PRIOR ART)
FIG. 13 is a front view of a conventional, prior-art, system for separating and cutting a surface portion of a paper roll.
Figure 13A:
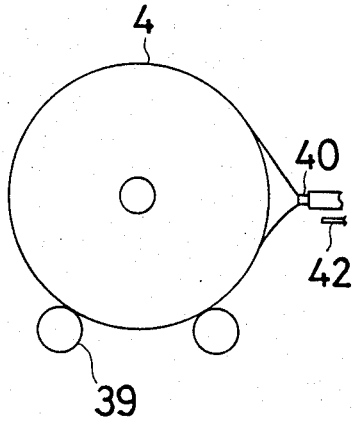
FIG. 13A (PRIOR ART)
FIG. 13A is a front view showing the surface portion of a paper roll being picked up by the system of FIG. 13.
Figure 13B:
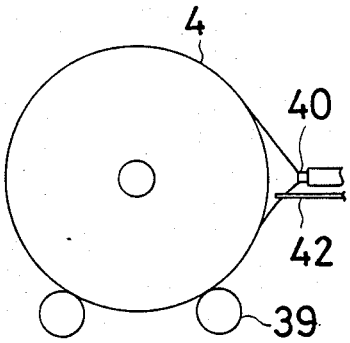
FIG. 13B (PRIOR ART)
FIG. 13B is a front view showing the surface portion of a paper roll being cut by the system of FIG. 13.

Subsequently, the paper roll 4, after its surface portion 4*c* is cut off, is prepared for the above-mentioned web pasting. More specifically, the paper roll 4 which has been unfastened is unrolled, and any damage or a stained portion is removed. Then, as shown in FIG. 12D, a tab 37 and tape 38 are fastened to a new leading end. These procedures are performed without removing the paper roll 4 from the rotary support 1 after the surface-portion cutting. Therefore, preparation for web pasting is efficiently carried out.

The structure of the cutting device 3 is not limited to that described in the above-mentioned embodiment, and any constitution and type of device may be employed, as long as the device is capable of cutting the released portion of the paper roll 4 surface.

Obvious changes may be made in the specific embodiment of the invention described herein within the spirit and scope of the invention claimed. All details contained herein are intended to be illustrative and not limiting in scope.

The embodiments of the invention in which an exclusive property or privilege are claimed are defined as follows:

1. A device for transversely cutting an outer layer of a paper roll comprising:

a rotary support which rotatably supports said paper roll, whose leading end is fastened to the rest of said roll, and rotates said paper roll on its axis;

a cutter guide device including a cutter-guide means for moving into a position for contacting a surface of said paper roll and being inserted under said leading end of said paper roll at a lateral portion thereof, said cutter guide means including a clearance forming means for forming a clearance under said outer layer;

a cutting device including a cutter means for reciprocating in a direction parallel to an axis of said paper roll, moving into said clearance formed on said paper roll, and cutting an entire width of the outer layer of said paper roll.

2. A device as claimed in claim 1, wherein said cutter guide includes an entering portion which can be positioned to juxtapose said lateral portion of the leading end of said paper roll and a protrusion portion being smoothly joined to said entering portion for moving said outer layer radially to form said clearance.

3. A device as claimed in claim 2, wherein said cutter means includes a guide which can be positioned to contact said paper roll under its outer layer and a cutting edge which extends upward from said guide.

4. A device as claimed in claim 3, wherein said cutter means is mounted to pivot and is pressed by a spring in such a direction that said guide can be forced to properly contact a surface of said paper roll under its outer layer.

5. A device as claimed in claim 3 further including a nozzle which can spray compressed gas in the direction of the lateral portion of the leading end of said paper roll.

6. A device as claimed in claim 5, wherein said nozzle can spray compessed gas in the direction of said clearance.

7. A device as claimed in claim 1, wherein said cutter means includes a guide which can be positioned to contact said paper roll under its outer layer and a cutting edge which extends upward from said guide.

8. A device as claimed in claim 7, wherein said cutter means is mounted to pivot and is pressed by a spring in such a direction that said guide can be forced to properly contact the surface of said paper roll under its outer layer.

9. A device as claimed in claim 7 further including a nozzle which can spray compressed gas in the direction of the lateral portion of the leading end of said paper roll.

10. A device as claimed in claim 9, wherein said nozzle can spray compressed gas in the direction of said clearance.

* * * * *